US009293844B2

(12) United States Patent
Wing et al.

(10) Patent No.: US 9,293,844 B2
(45) Date of Patent: Mar. 22, 2016

(54) FOUR-POST TERMINAL BLOCK WITH THROUGH POSTS

(71) Applicant: Siemens Industry, Inc., Alpharetta, GA (US)

(72) Inventors: Barden J. Wing, New Albany, IN (US); Zhenzhong Long, Prospect, KY (US)

(73) Assignee: SIEMENS INDUSTRY, INC., Alpharetta, GA (US)

( * ) Notice: Subject to any disclaimer, the term of this patent is extended or adjusted under 35 U.S.C. 154(b) by 143 days.

(21) Appl. No.: 14/190,365

(22) Filed: Feb. 26, 2014

(65) Prior Publication Data

US 2015/0244087 A1 Aug. 27, 2015

(51) Int. Cl.
*H01R 13/64* (2006.01)
*H01R 9/24* (2006.01)

(52) U.S. Cl.
CPC ..... *H01R 9/2408* (2013.01); *H01R 9/24* (2013.01)

(58) Field of Classification Search
CPC ..... H01R 13/6315; H01R 13/518
USPC ..... 439/248, 247, 700, 540.1, 559
See application file for complete search history.

(56) References Cited

U.S. PATENT DOCUMENTS

| | | | | |
|---|---|---|---|---|
| 1,948,470 | A | 2/1934 | Lavarack | |
| 8,299,811 | B2 | 10/2012 | Long | |
| 2003/0077932 | A1* | 4/2003 | Lewinnek | H01R 13/6315 439/246 |
| 2010/0112837 | A1 | 5/2010 | Lewis | |

* cited by examiner

*Primary Examiner* — Phuongchi T Nguyen

(57) ABSTRACT

A terminal block, terminal board and terminal board assembly for terminating and testing railroad wires. The terminal block comprises a plurality of through-posts, allowing wiring and other components to be attached on posts on first and/or second sides of the terminal block. A surge protection component, control test link, and first wiring may be pre-installed on one side of the terminal block and terminal board, providing for quick installation prior to installing the terminal board assembly in the field. The through-posts also simplify the mounting of the terminal block to the terminal board, and the grounding for the terminal board.

18 Claims, 10 Drawing Sheets

FOUR-POST TERMINAL BLOCK WITH THROUGH POSTS

FIELD OF THE INVENTION

Embodiments of the invention relate to railroad equipment such as e.g., terminal blocks used with terminal boards and, more particularly, to a four-post terminal block with a plurality of through posts.

BACKGROUND

Terminal boards, including terminal blocks for terminating and testing of underground railroad wires connected to signals, track circuits and other devices on the railroad track or along the wayside, are generally protected by and provided within a bungalow or similar structure at various locations along the railroad track. Current terminal board configurations may include multiple terminal blocks installed on a terminal plane, which is usually an aluminum sheet. A four-post terminal block usually includes posts for equipment, ground, line and test connections. The posts extend from the front side of the block's body so that the various connections can be made inside the bungalow. The back side of the terminal block is mounted to the terminal plane using mounting screws. One or more underground cables are routed through the floor or a wall of the bungalow, through the aluminum sheet and connected to respective posts on the front side of the terminal blocks. Factory wiring is connected to posts at the front side of the terminal block and to equipment inside the bungalow for providing power and/or control signals to the equipment located on the track or along the wayside.

Such a configuration, however, requires a piece of plywood or other suitable material to be incorporated on the rear side of the aluminum sheet. Moreover, with current terminal board configuration designs, installation is time consuming and difficult due to the necessity of terminating cables and installing surge protectors and test links at the site. Field maintenance is also undesirably inconvenient due to the requirement of testing cables and replacing defective components such as the lightning arresters. Additionally, costs associated with wiring material and wiring labor are high. Thus, improved terminal board and block configurations are desired.

SUMMARY

Embodiments disclosed herein provide a terminal block for use with a railroad terminal board. The terminal block comprises a terminal block body having first and second sides; a plurality of first connection posts extending from the first side of the body; and a plurality of second connection posts extending from the second side of the body, each of said plurality of second connection posts being connected to a respective one of said plurality of first connection posts.

In another embodiment, a terminal board for railroad equipment is provided. The terminal board comprises a plane; and at least one terminal block mounted to the plane. Each terminal block comprises a terminal block body having first and second sides; a plurality of first connection posts extending from the first side of the body; and a plurality of second connection posts extending from the second side of the body, each of said plurality of second connection posts being connected to a respective one of said plurality of first connection posts. A unique 3-way control test link may also be provided over a plurality of first connection posts. Grounding for the terminal board is provided via a connection between the plane and one of the plurality second posts.

Further areas of applicability of the present disclosure will become apparent from the detailed description, drawings and claims provided hereinafter. It should be understood that the detailed description, including disclosed embodiments and drawings, are merely exemplary in nature intended for purposes of illustration only and are not intended to limit the scope of the invention, its application or use. Thus, variations that do not depart from the gist of the invention are intended to be within the scope of the invention.

DETAILED DESCRIPTION

Figure 1:
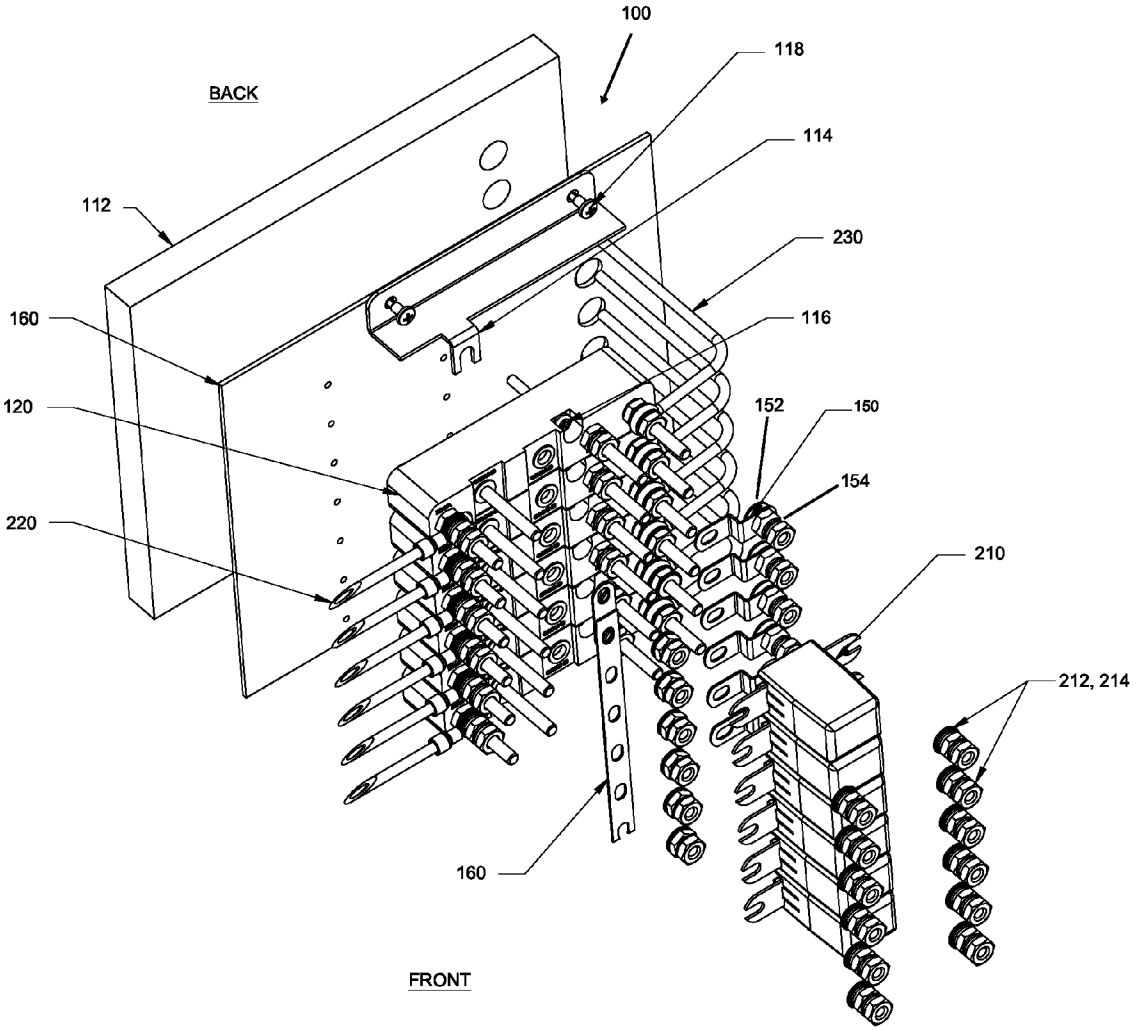
FIG. 1 illustrates a terminal board including a plurality of four-post terminal blocks.
Figure 2:
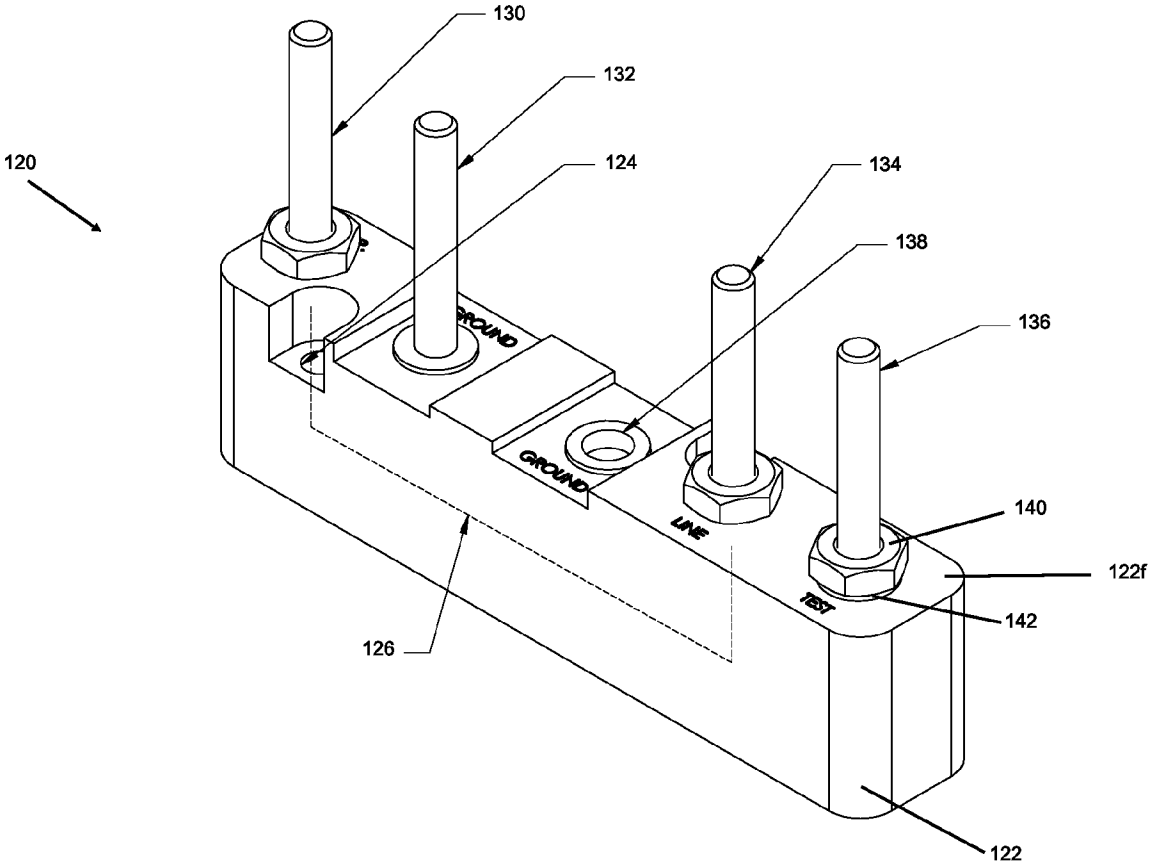
FIGS. 2 and 3 illustrate a terminal block included in the terminal board of FIG. 1.
Figure 3:
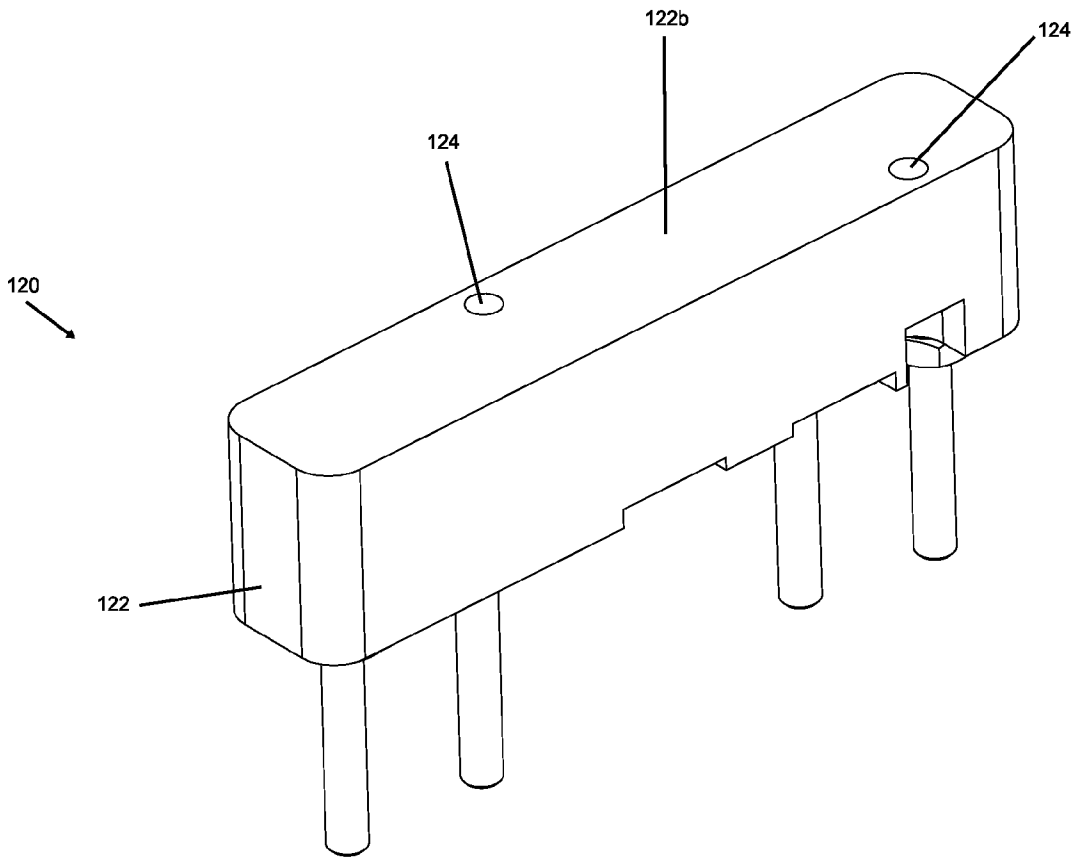

FIG. 1 illustrates a terminal board 100 comprising a terminal board plane 110 mounted to a terminal board plane support 112. The terminal board plane 110 may be formed of a conductive material (e.g., aluminum) to serve as a low impedance ground plane. The terminal board plane support 112 may be formed of wood (e.g., plywood) or some other strong supporting substrate. It should be understood that the plane 110 may be mounted on, or form part of a vertical wall located within a bungalow (not shown) such that the front of the plane 110 may be accessed when entering the bungalow through a front entrance and a back of the plane may be accessed from a rear entrance of the bungalow or by walking around the wall. It should be understood that several rows of four-post terminal blocks 120 may be mounted on the plane 110, with the terminal blocks 120 in one horizontal row in close proximity to, and in some cases in contact with, terminal blocks in a vertically adjacent row. Configurations with 12 or 24 rows of terminal blocks 120 are not uncommon FIGS. 2 and 3 illustrate details of a terminal block 120. The terminal block 120 includes a body 122 having a front 122*f* and a back 122*b*. Four posts 130, 132, 134, 136 extend from the front 122*f* of the body 122. The posts 130, 132, 134, 136 are formed of a bonze rod, which may be threaded, preferably with a thread approved by AREMA (American Railway Engineering and Maintenance-of-Way Association). In the illustrated example, the first post 130 is an equipment post, the second post 132 is a ground post, the third post 134 is a line post and the fourth post 136 is a test post. Internal wiring 126 connects the first (i.e., equipment) and third (i.e., line) posts 130, 134. The function and use of equipment, ground, line and test posts for a railroad application are well known in the art and are not discussed further.

As can be seen, two holes 124 are provided through the terminal block body 122 for mounting the terminal block 120 to the plane 110 and support 112 using e.g., screws 116 (illustrated in FIG. 1). Nuts 140 and washers 142 may be used with the posts 130, 132, 134, 136 when making connections to cabling or other devices (e.g., test links, lightning arresters, equalizers, etc.). In the illustrated example, the terminal block 120 includes an additional grounding hole 138 through the body 122 in case additional grounding connections are needed.

Referring again to FIG. 1, the ground posts (i.e., second posts 132) of installed terminal blocks 120 are connected to each other and a grounding bracket 114 via a grounding link 160. The grounding bracket 114 is connected to an upper portion of the terminal plane 110 by screws 118. Although not shown, a second grounding bracket is connected to a bottom portion of the terminal board plane 110. The grounding link 160 would be connected to both grounding brackets and any ground posts therebetween. Because the grounding link 160 is connected to the grounding brackets, which are connected to the grounded terminal board plane 110, these connections provide the grounding path for the components of the terminal board 100.

An insulated test link 150 is provided for each terminal block 120. Each test link 150 has a first hole that is sized to accept the third post 134 (i.e., line post) and a second hole that is sized to accept the fourth post 136 (i.e., test post). The second hole is lined with an insulating material 152. The insulating material 152 serves to electrically isolate the test link 150 from the fourth post 136 unless a test nut 154 is installed on the fourth post 136 and over the test link 150. The use of a test link 150 for a railroad application is well known in the art and is not discussed further.

Figure 4:
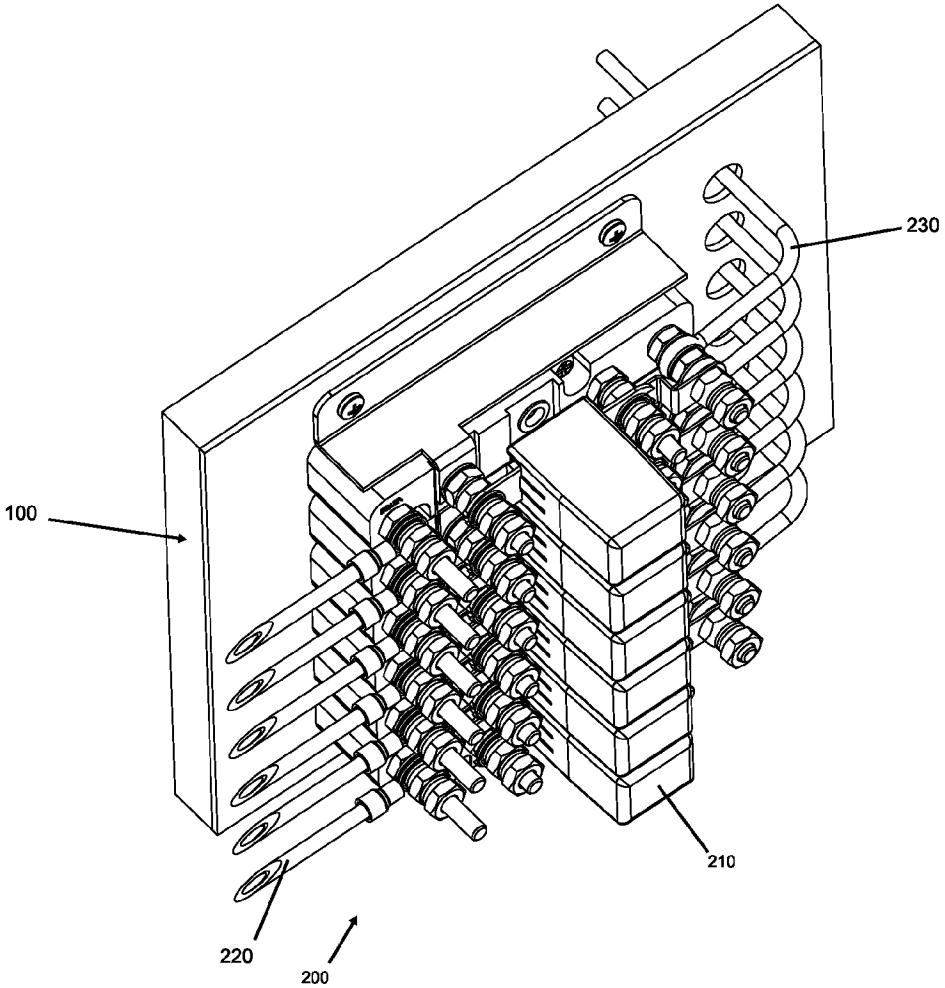
FIG. 4 illustrates a terminal board assembly comprising the terminal board of FIG. 1.

FIG. 4 illustrates a terminal board assembly 200 comprising the terminal board 100 illustrated in FIG. 1. In addition to the terminal board 100, the terminal board assembly 200 may include surge protection components 210 connected between the second and third posts 132, 134 of respective terminal blocks 120 via washer 212 and nuts 214 sized to fit over the posts 132, 134. The surge protection component 210 may be e.g., a lightning arrester and/or an equalizer. In addition, the assembly 200 may also include first wiring or cable 220 connected to the first posts 130 of respective terminal blocks 120 via washers and nuts sized to fit over the first post 130. The first wiring 220 may be factory wire, pre-installed as part of the terminal board assembly 200 prior to installation in the field. The wiring 220 is typically connected to control equipment located inside the bungalow.

The terminal board assembly 200 may further include second wiring or cable 230 connected to the fourth post 136 of respective terminal blocks 120 via washers and nuts sized to fit over the fourth post 136. The second wiring 230 may be underground wiring or cable that is installed in the field once the terminal board assembly 200 is positioned in its desired location. As can be seen from FIGS. 1 and 4, the second wiring 230 is passed through holes in the terminal board plane 110 and terminal board plane support 112.

The terminal board 100 and terminal board assembly 200 are not without their shortcomings. For example, the second wiring/cable 230 (e.g., underground cabling) is installed by the railroad personnel in the field at the installation site (e.g., bungalow). Since the cabling 230 must be connected and terminated on the terminal block 120 before other hardware is added to the block 120, the terminal board's hardware (e.g., test links 150 and surge protection components 210) cannot be installed at the factory—i.e., they must be installed in the field. This increases installation time, which is undesirable. In addition, a terminal board plane support 112 (e.g., piece of plywood) must be provided behind the terminal board plane 110 (e.g., grounded aluminum sheet) to support the installed cable 230 and to accept the screws 116 used to mount the terminal blocks 120. The underground cables 230 are brought into the bungalow from behind the terminal board plane 110. To do so, holes must be provided in the terminal board plane 110 and terminal board plane support 112, and the cables 230 must be pulled through the holes to the front of the terminal board 100, increasing the costs and labor associated with the installation.

In addition, the grounding mechanism for the terminal board 100 and terminal board assembly 200 is complex and the resulting grounding path is relatively long. The ground posts (i.e., second posts 132) are connected with different grounding links 160, which are then connected to the upper and bottom grounding brackets. The grounding brackets must then be screwed to the terminal board plane 110 to complete the grounding path. It can be appreciated that there is a need to reduce the number of components needed for the grounding path and to shorten the length of the path in general.

Figure 5:
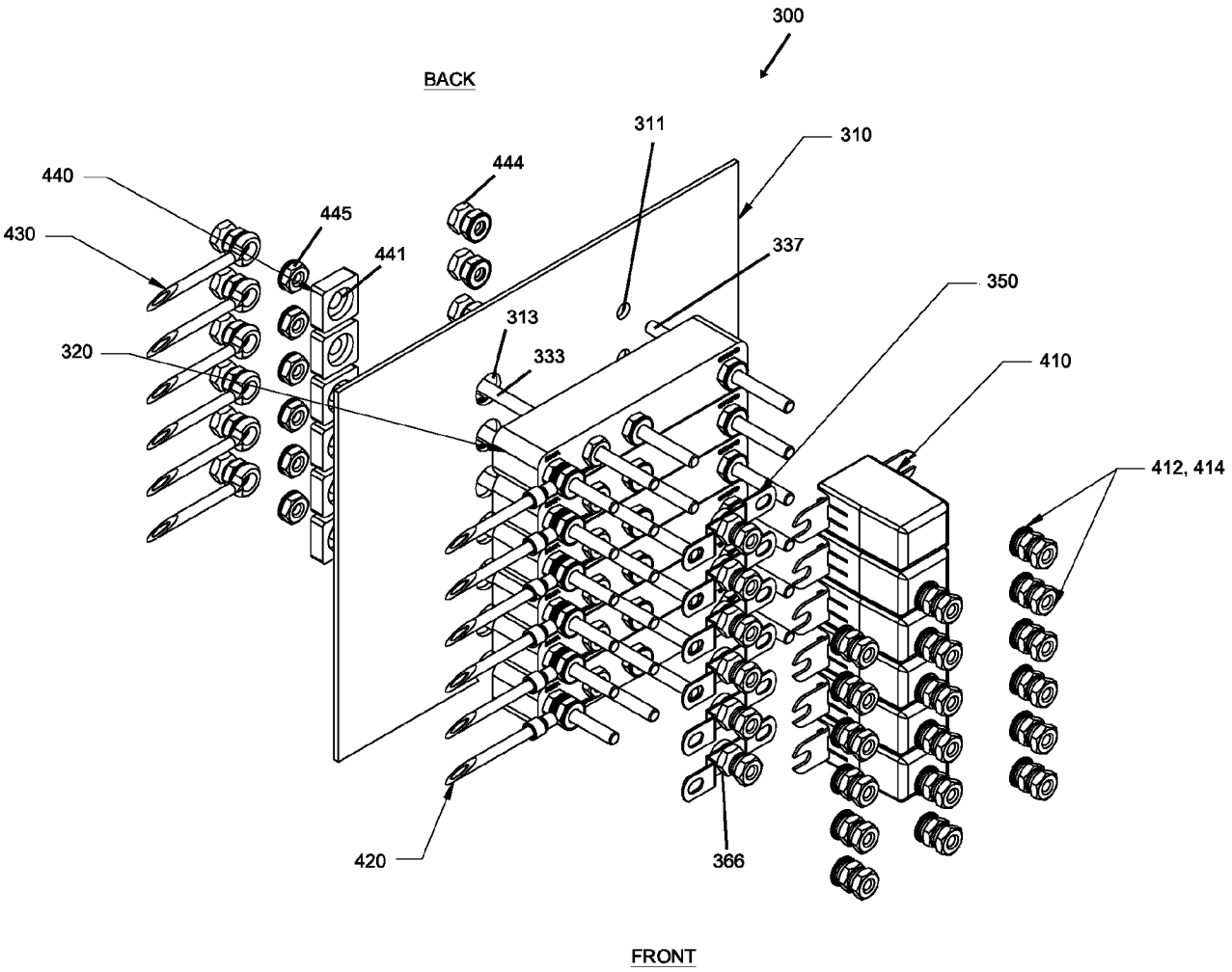
FIG. 5 illustrates a terminal board including a plurality of four-post terminal blocks constructed in accordance with an embodiment disclosed herein.

FIG. 5 illustrates an example of a terminal board 300 constructed in accordance with an embodiment disclosed herein. The terminal board 300 includes a terminal board plane 310, which may be formed of a conductive material (e.g., aluminum) to serve as a low impedance ground plane. As will become apparent, due to the configuration of the terminal board 300 and terminal blocks 320 used with the board 300, the terminal board plane 310 will not have to be mounted to a support, which was required for the terminal board 100 illustrated in FIG. 1. It should be appreciated that the plane 310 may be mounted on, or form part of a vertical wall located within a bungalow (not shown) such that the front of the plane 310 may be accessed when entering the bungalow through a front entrance and a back of the plane 310 may be accessed from a rear entrance of the bungalow or by walking around the wall.

At least one four-post terminal block 320 constructed in accordance with a disclosed embodiment is mounted to the terminal board plane 310. It should be appreciated that several rows of four-post terminal blocks 320 may be mounted on the plane 310, with the terminal blocks 320 in one horizontal row in close proximity to, and in some cases in contact with, terminal blocks 320 in a vertically adjacent row. Configurations with 12, 24 or more rows of terminal blocks 320 may be used.

Figure 6:
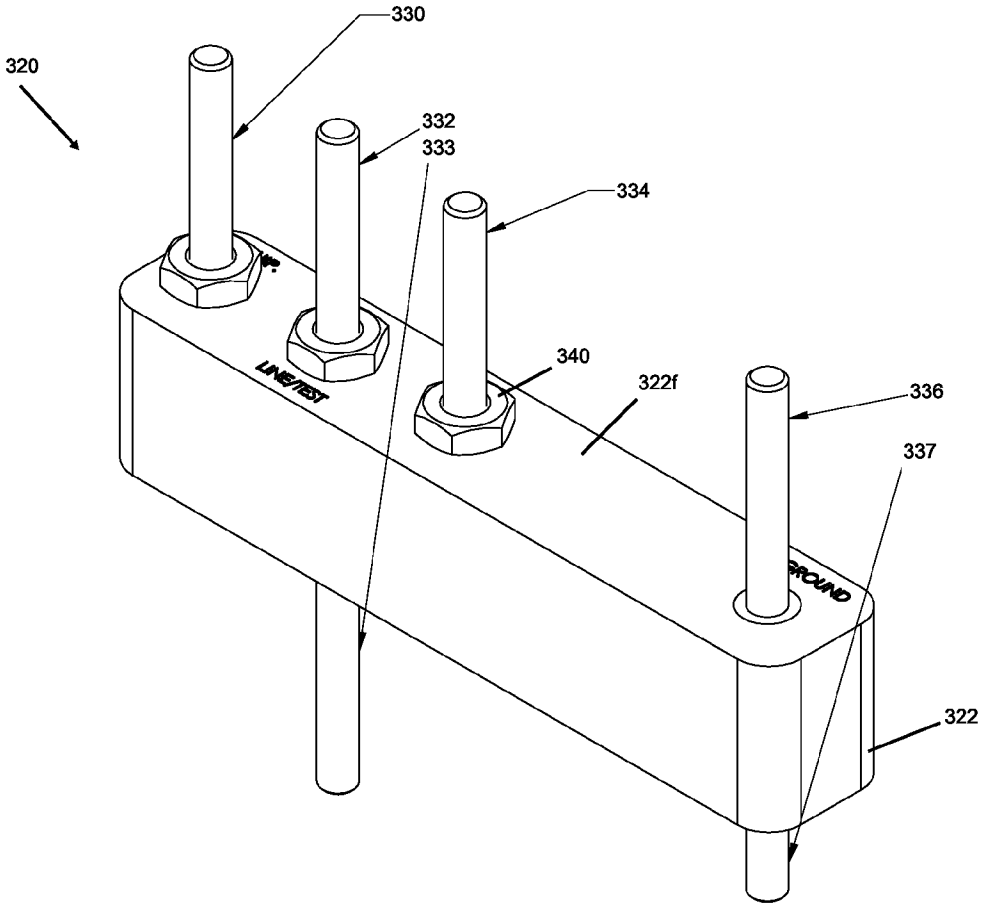
FIGS. 6 and 7 illustrate an example terminal block according to an embodiment disclosed herein and included in the terminal board of FIG. 5.
Figure 7:
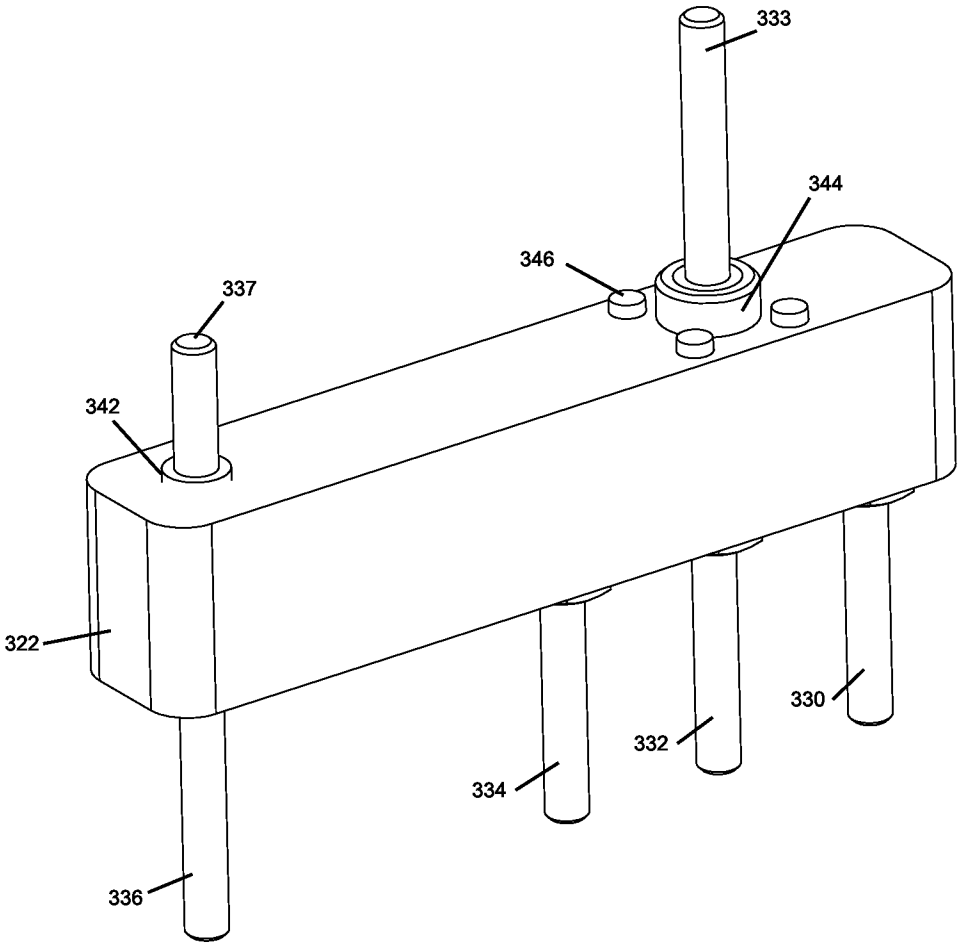

FIGS. 6 and 7 illustrate details of the novel terminal block 320 in accordance with the disclosed embodiments. The terminal block 320 includes a body 322 having a front **322*f* and a back 322*b*. Four front posts 330, 332, 334, 336 extend from the front 322*f* of the body 322. In addition, two back posts 333, 337 extend from the back 322*b* of the body 322. Internal to the body 322, the second front post 332 is connected to the first back post 333 and the fourth front post 336 is connected to the second back post 337. In one embodiment, the second front post 332 and first back post 333 are portions of a single post that is passed through the front and back sides of the body 322 and the fourth front post 336 and second back post 337 are portions of a single post that is passed through the front and back sides of the body 322. In either scenario, the external appearance of the terminal block 320 and the posts 330, 332, 333, 334, 336, 337** would look the same.

In one embodiment, the posts 330, 332, 333, 334, 336, 337 are formed of a bronze rod, which may be threaded, preferably with a thread approved by AREMA (American Railway Engineering and Maintenance-of-Way Association). In the illustrated example, the first front post 330 is an equipment post, the second front post 332 and first back post 333 comprise line/test posts, the third front post 334 is a surge protection component mounting post 334 and the fourth front post 336 and second back post 337 comprise grounding posts. As will become apparent, due to the configuration of the terminal board 300, terminal block posts 330, 332, 333, 334, 336, 337 and an insulated test link 350 (discussed below) internal wiring connecting two or more of the front posts are not required. The function and use of equipment, ground, line and test posts for a railroad application are well known in the art and are not discussed further.

As can be seen in FIG. 7, the back side 322*b* of the body 322 contains a raised ring portion 342 around the second back post 337. The raised ring portion 342 will be formed of a conductive material (e.g., bronze) and is used for mounting and grounding purposes when the terminal block 320 is mounted to the terminal board plane 310. The raised ring portion 342 is sized so that it will not fit through a corresponding hole 311 (FIG. 5) in the plane 310, causing the ring 342 to make contact with the front side of the plane 310. A back shoulder 344 is formed on or placed on the back side 322*b* of the body 322 around the first back post 333. The back shoulder 344 is formed of insulting material and is used for electrical isolation from the plane 310. The back shoulder 344 is sized to fit through a corresponding hole 313 (FIG. 5) in the plane 310 when the terminal block 320 is installed on the plane 310. One or more protrusions 346 are provided on the back side 322*b* around the shoulder 344. The protrusions 346 are used to keep the back side 322*b* of the body 322 from touching the plane 310 when the block 320 is installed on the plane 310. This can reduce stress due to torque or an uneven surface of the plane 310. The height of the raised ring portion 342 and the protrusions 346 are preferably the same. As will become apparent, due to the configuration of the terminal board 300 and, specifically the back posts 333, 337, the body 322 does not need holes in order to be mounted to the terminal board plane 310. Nuts 340 and washers (not shown in detail) may be used with the posts 330, 332, 333, 334, 336, 337 when making connections to cabling or other devices (e.g., test links, lightning arresters, equalizers, etc.).

Figure 8A:
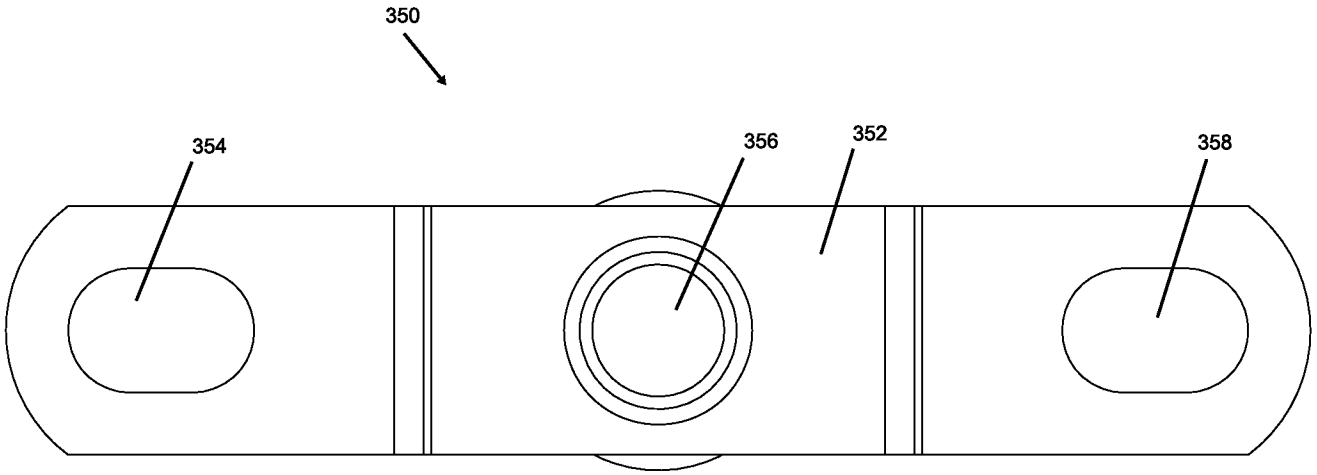
FIGS. 8*a* and 8*b* illustrate an example test link according to an embodiment disclosed herein and included in the terminal board illustrated in FIG. 5.
Figure 8B:
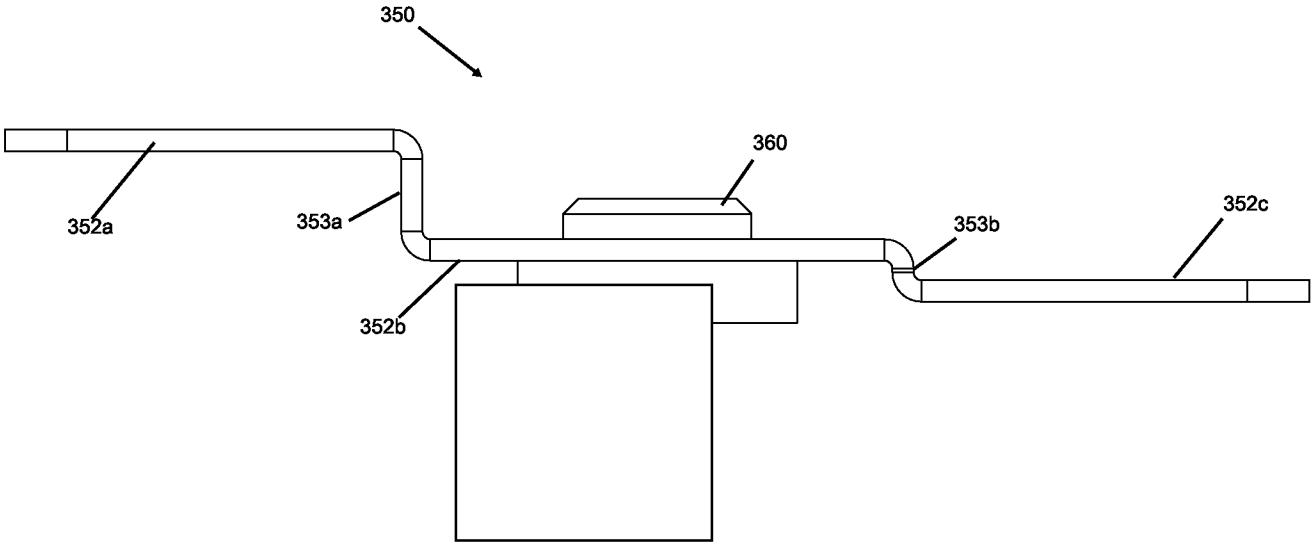

Referring to FIGS. 5, 8*a* and 8*b*, the insulated test link 350 is provided for each terminal block 320 used with the terminal board 300. Each test link 350 has a body 352 comprising three horizontal portions 352*a*, 352*b*, 352*c* that are offset from each other. The first portion 352*a* has a first hole 354 that is sized to accept the first front post 330 (i.e., equipment post). The first portion 352*a* is connected to the second portion 352*b* by a first vertical wall 353*a*. The second portion 352*b* is offset from the first portion 352*a* by the length of the first vertical wall 353*a* and includes a second hole 356 that is sized to accept the second front post 332 (i.e., line/test post). The second portion 352*b* is connected to the third portion 352*c* by a second vertical wall 353*b*. The third portion 352*c* is offset from the second portion 352*b* by the length of the second vertical wall 353*b* and includes a third hole 358 that is sized to accept the third front post 334 (i.e., surge protection component mounting post). The test link 350 is considered to be a 3-way test link because it interconnects three front posts (i.e., equipment post 330, line/test post 332 and surge protection component mounting post 334). Because of this 3-way connection, internal wiring 126 required for terminal block 120 (FIG. 1) is no longer needed.

The second hole 356 is lined with an insulating material 360. The insulating material 360 serves to electrically isolate the test link 350 from the second front post 332 unless a test nut 366 is installed on the second front post 332 and over the test link 350. When installed, the illustrated test link 350 is used to connect the first, second and third front posts 330, 332, 334. It is preferred for the installation of the test link 350 to occur at the factory, plant or other facility before the terminal board 300 and/or terminal blocks 320 are installed in the field.

Figure 9:
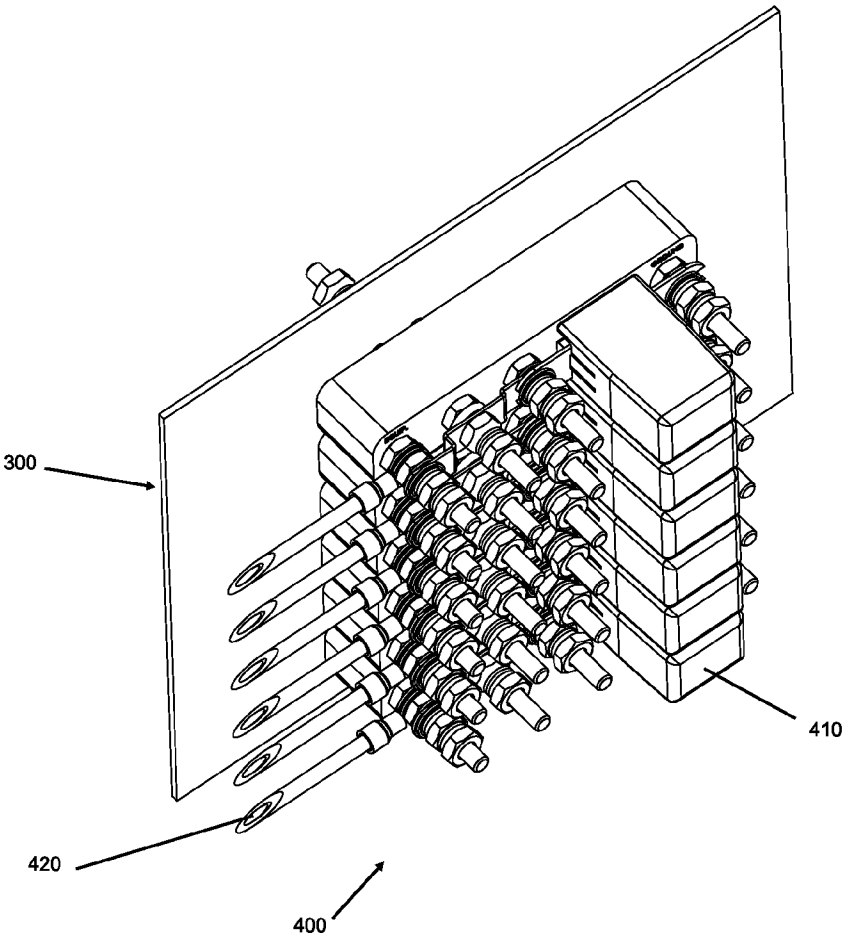
FIG. 9 illustrates a terminal board assembly according to an embodiment disclosed herein and comprising the terminal board of FIG. 5.

FIG. 9 illustrates a terminal board assembly 400 comprising the terminal board 300 illustrated in FIG. 5. In addition to the terminal board 300, the terminal board assembly 400 may include surge protection components 410 connected between the third and fourth front posts 334, 336 of respective terminal blocks 320 via washer and nuts 412, 414 sized to fit over the posts 334, 336. The surge protection component 410 may be e.g., a lightning arrester and/or an equalizer. In addition, the assembly 400 may also include first wiring or cable 420 connected to the first front posts 330 of respective terminal blocks 320 via washers and nuts sized to fit over the first front post 330. The first wiring 420 may be factory wire, pre-installed as part of the terminal board assembly 400 prior to installation in the field. The wiring 420 is typically connected to control equipment located inside the bungalow.

The terminal board assembly 400 may further include second wiring or cable 430 connected to the first back post 333 of respective terminal blocks 320 via washers (not shown) and nuts 442 sized to fit over the first back post 333. In one embodiment, an insulation block 440 is provided between the cable 430 and the back of the plane 410. The insulation block 440 comprises a hole 441 sized to accept the shoulder 344 of an installed terminal block 320. The second wiring 430 may be underground wiring or cable that is installed in the field once the terminal board assembly 400 is positioned in its desired location (discussed below).

It should be appreciated that one or more terminal blocks 320 can be mounted to the terminal board plane 310 at the factory or other facility prior to installing the terminal board 300 in the field. Referring to FIG. 5, to mount a terminal block 320 to the terminal board plane 310, the first and second back posts 333, 337 of the block 320 are passed through respective holes 313, 311 in the terminal board plane 310. An insulation block 440 is placed over the shoulder 344 associated with the first back post 333 (which extends through the backside of the plane 310). A nut 445 and washer are used to complete the connection. A nut 444 and washer (not shown) are placed over the second back post 337 to complete the connection of the terminal block 320 to the terminal board plane 310. This same procedure is done for all of the terminal blocks 320 that are to be installed on the terminal board 300. The wiring 420, test link 350 and surge protection component 410 for each terminal board 320 can be installed after mounting the block 320 to the plane 310. Once the bungalow with the terminal board 300 is installed in the field, external cabling 430 can be connected to the first back posts 330 with nuts 442 and washers.

It can be appreciated that the terminal block 320, terminal board 300 and terminal board assembly 400 achieve several benefits over the terminal block 120, terminal board 100 and terminal board assembly 200 discussed above. For example, the underground cabling 430 will be installed on the back of the grounded terminal board plane 310 (aluminum sheet) by railroad personnel in the field. Since the cabling 430 is installed on the back of the grounded terminal board plane 310, it is not necessary to pull the cable through holes to the front of the plane 310 for termination. Thus, field installation is simplified and installation time will be reduced. Moreover, as mentioned above, the hardware (terminal blocks, test links, arrestors etc.) can be installed on the front of the terminal board plane 310 in the factory, further reducing field installation time.

As described above, the back posts 333, 337 are used to mount the terminal blocks 320 to the terminal board 300. This eliminates the need for the terminal board plane support (i.e., plywood) and mounting screws. Moreover, the through ground post (i.e., second back 337) allows a direct ground connection to the terminal board plane 310. All of the ground links and brackets used in the terminal board 100 can be eliminated.

As can be appreciated, the new terminal block 320 eliminates the internal wiring and additional grounding of the terminal block 120. Moreover, there is a more definitive separation between the "clean"(case) wires on the front of the terminal board plane 310 and the "dirty"(underground) cables on the back, which is a requirement of some railroads.

The foregoing examples are provided merely for the purpose of explanation and are in no way to be construed as limiting. While reference to various embodiments is made, the words used herein are words of description and illustration, rather than words of limitation. Further, although reference to particular means, materials, and embodiments are shown, there is no limitation to the particulars disclosed herein. Rather, the embodiments extend to all functionally equivalent structures, methods, and uses, such as are within the scope of the appended claims.

Additionally, the purpose of the Abstract is to enable the patent office and the public generally, and especially the scientists, engineers and practitioners in the art who are not familiar with patent or legal terms or phraseology, to determine quickly from a cursory inspection the nature of the technical disclosure of the application. The Abstract is not intended to be limiting as to the scope of the present inventions in any way.

What is claimed is:

1. A terminal block for use with a railroad terminal board, said terminal block comprising:

a terminal block body having first and second sides;

a plurality of first connection posts extending from the first side of the body; and a plurality of second connection posts extending from the second side of the body, each of said plurality of second connection posts being connected to a respective one of said plurality of first connection posts, said plurality of second connection posts being configured to mount said terminal block to the railroad terminal board without a support and mounting screws.

2. The terminal block of claim 1, wherein there are four first connection posts and two second connection posts.

3. The terminal block of claim 1, wherein the first and second connection posts are made of bronze.

4. The terminal block of claim 1, further comprising:

a raised conductive ring connected to and around a first one of said second connection posts and fixedly in contact with the second side of the body.

5. The terminal block of claim 4, further comprising:

an insulated shoulder around a second one of said second connection posts and in contact with the second side of the body; and a plurality of protrusions around the shoulder and in connect with the body.

6. A terminal board for railroad equipment, said terminal board comprising:

a plane; and at least one terminal block mounted to the plane, each terminal block comprising:

a terminal block body having first and second sides;

a plurality of first connection posts extending from the first side of the body; and a plurality of second connection posts extending from the second side of the body, each of said plurality of second connection posts being connected to a respective one of said plurality of first connection posts, said plurality of second connection posts being configured to mount said at least one terminal block to the terminal board without a support and mounting screws.

7. The terminal board of claim 6, wherein there are four first connection posts and two second connection posts on each terminal block.

8. The terminal board of claim 6, wherein the plane comprises a conductive material and each terminal block further comprises:

a raised conductive ring connected to and around a first one of said second connection posts and fixedly in contact with the second side of the body, wherein the raised conductive ring contacts a first side of the plane.

9. The terminal board of claim 8, wherein each terminal block further comprises:

an insulated shoulder around a second one of said second connection posts and in contact with the second side of the body, wherein the insulated shoulder is provided through a hole in the plane and extends to a second side of the plane; and a plurality of protrusions around the shoulder and in contact with the body and first side of the plane.

10. The terminal board of claim 8, wherein each terminal block further comprises: a three-way test link provided over three first connection posts; and a test nut provided over one of the first connection posts to establish a conductive path between the three first connection posts.

11. The terminal board of claim 8, wherein each terminal board is mounted to the plane by passing the second connection posts through respective holes in the plane and securing the second connection posts.

12. The terminal board of claim 8, wherein each terminal block is grounded through contact between one of the second connection posts with the conductive material of the plane.

13. A terminal board assembly for railroad equipment, said terminal board assembly comprising:

a terminal board comprising:

a plane;

at least one terminal block mounted to the plane, each terminal block comprising:

a terminal block body having first and second sides, a plurality of first connection posts extending from the first side of the body, a plurality of second connection posts extending from the second side of the body, each of said plurality of second connection posts being connected to a respective one of said plurality of first connection posts, a three-way test link provided over three first connection posts, and a test nut provided over one of the first connection posts to establish a conductive path between the three first connection posts; and at least one surge protection component connected to a respective terminal block, each surge protection component being provided between one of said first connection posts connected to the three-way test link and one first connection post that is not connected to the three-way test.

14. The terminal board assembly of claim 13 further comprising first wiring connected to a first connection post that is connected to the three-way test link.

15. The terminal board assembly of claim 13, wherein the plane comprises a conductive material and each terminal block further comprises:

a raised conductive ring connected to and around a first one of said second connection posts and in contact with the second side of the body; and an insulated shoulder position around a second one of said second connection posts and in contact with the second side of the body, wherein the raised conductive ring contacts a first side of the plane, and the insulated shoulder is provided through a hole in the plane and extends to a second side of the plane.

16. The terminal board assembly of claim 15, wherein each terminal block further comprises a plurality of protrusions around the shoulder and in connect with the body and first side of the plane.

17. The terminal board assembly of claim 15, wherein each terminal block is mounted to the plane by passing the second connection posts through respective holes in the plane and securing the second connection posts and the assembly further comprises external wiring connected to one of the second connection posts.

18. The terminal board of claim 15, wherein each terminal block is grounded through contact between one of the second connection posts with the conductive material of the plane.

* * * * *